United States Patent [19]

Schilling et al.

[11] 4,085,694

[45] Apr. 25, 1978

[54] DUAL RUDDER ASSEMBLY

[75] Inventors: Karl Schilling; Horst Rathert, both of Minden, Germany

[73] Assignee: Werftunion G.m.b.H. & Co., Dortmund, Germany

[21] Appl. No.: 663,816

[22] Filed: Mar. 4, 1976

[30] Foreign Application Priority Data

Mar. 8, 1975 Germany ..... 2510256

[51] Int. Cl.[2] ..... B63H 25/06

[52] U.S. Cl. ..... 114/163; 115/42

[58] Field of Search ..... 114/162, 163, 164, 166, 114/170; 115/12 R, 42

[56] References Cited

U.S. PATENT DOCUMENTS

| | | | |
|---|---|---|---|
| 899,359 | 9/1908 | Wadagaki | 115/42 |
| 969,642 | 9/1910 | Lund | 114/163 |
| 3,101,693 | 8/1963 | Schilling | 114/163 |
| 3,137,265 | 6/1964 | Meyerhoff | 115/12 R |
| 3,442,244 | 5/1969 | Clark et al. | 114/163 |
| 3,487,805 | 1/1970 | Satterthwaite et al. | 115/42 |
| 3,872,817 | 3/1975 | Duryea | 114/163 |

FOREIGN PATENT DOCUMENTS

| | | | |
|---|---|---|---|
| 935,835 | 6/1949 | Germany | 114/163 |
| 2,303,299 | 10/1974 | Germany | 114/163 |

*Primary Examiner*—Trygve M. Blix
*Assistant Examiner*—Sherman D. Basinger
*Attorney, Agent, or Firm*—Michael J. Striker

[57] ABSTRACT

A rudder assembly for a ship having an upright keel plane and a drive for generating a screw race passing backwardly along the plane comprises a pair of like rudders lying in the race and pivotal about respective upright axes spaced symmetrically to opposite sides of the keel plane. Each rudder has a central plane lying parallel to the keel plane during normal straight forward travel of the ship and has a non-concave inner face turned toward the keel plane and an outer face formed by a convex front portion generally in front of the respective axis and a concave rear portion generally behind the respective axis. The rear portions diverge from the respective central planes by angles between 2° and 10°, and the inner face has a rear portion similarly forming an angle of between 2° and 8° with the respective central plane. These rudders may be controlled individually in order to stop and even reverse the ship with a continuously backwardly moving screw race. In addition a pair of such rudders may be provided on a twin-screw ship, one for each screw race.

1 Claim, 22 Drawing Figures

FIG. 5
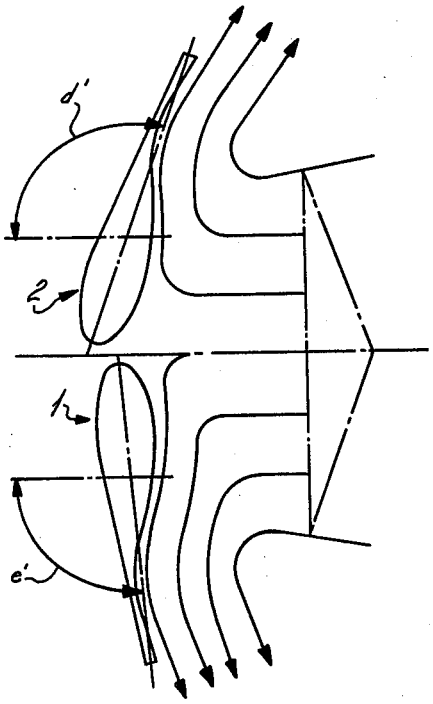
FIG. 6
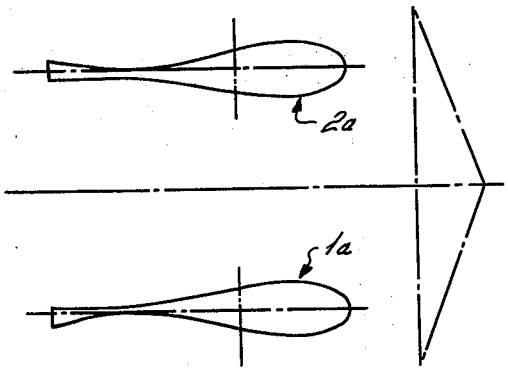
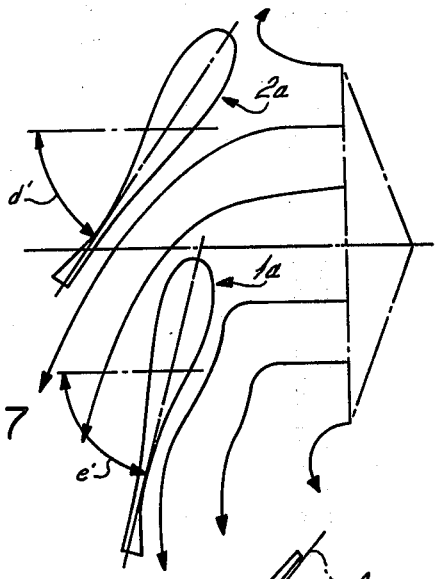
FIG. 7
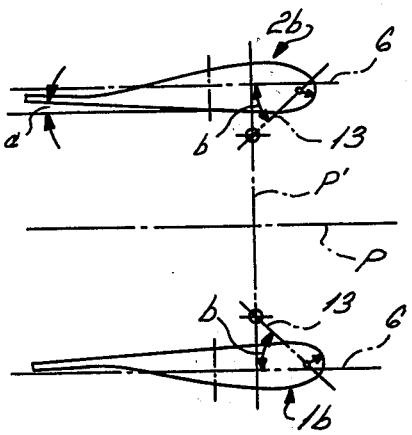
FIG. 8
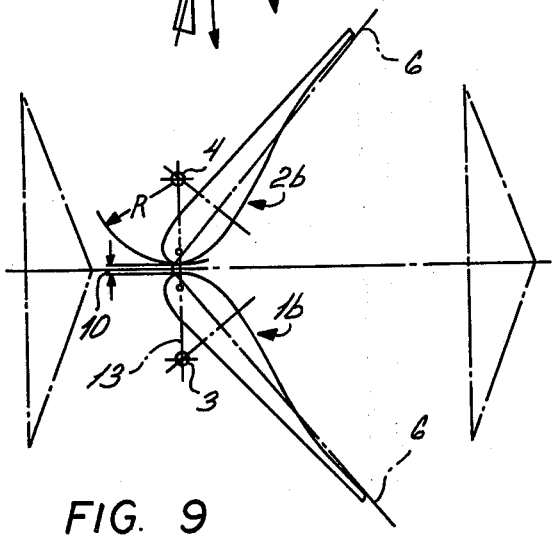
FIG. 9

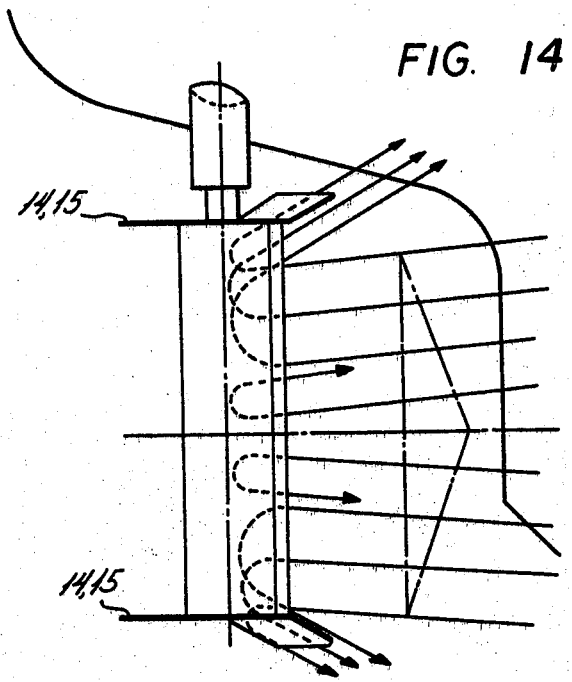
FIG. 14
FIG. 15
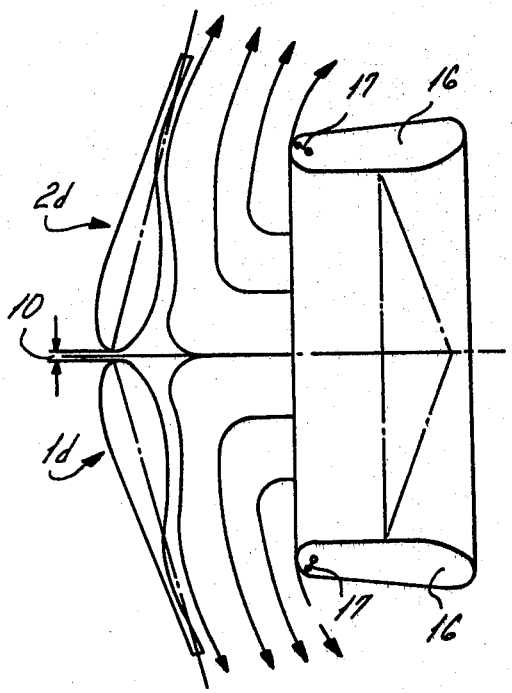
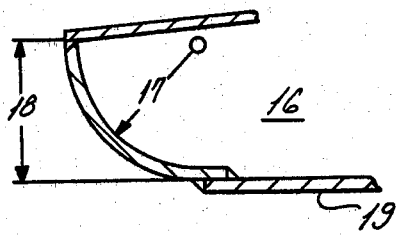
FIG. 16

DUAL RUDDER ASSEMBLY

BACKGROUND OF THE INVENTION

The present invention relates to a rudder assembly for a ship. More particularly this invention concerns a multiple-rudder assembly of the so-called balanced type.

A balanced-type ship rudder assembly is known having a pair of like rudders pivotal about respective upright axes spaced symmetrically to opposite sides of the keel plane of the ship. Means is provided on the ship for generating a screw race, that is a backwardly flowing column of water, which runs along the plane between and around the two rudders. Each rudder has a central plane which extends parallel to the keel axis when the ship is being displaced straight forward, and which passes through the approximate center of the body of the respective rudder. The pivot axis normally lies on this center line but may, as described in German Pat. No. 949,451, be parallel to this central plane and spaced inwardly therefrom toward the keel plane.

A rudder assembly is known (see German Pat. No. 935,835) wherein the inner faces of the rudders are generally flat. In the normal rudder position, that is the position they assume for straight-ahead travel of the ship, these inner faces converge at an angle of 5°. The pivot axes of the rudders are rigidly linked together so that the central planes of the two rudders always lie at the same angle to the keel axis, this angle being 0° for straight-ahead travel as described above. Thus, when the two rudders are deflected to one side for a turn, the inner faces will not lie at the same angle to the keel axis, but the one will lie at an angle 5° greater than the other. Thus the screw race is deflected off the outwardly lying rudder more quickly than the inner rudder so that the advantageous sharp deflection on the outside of the rudder is considerably reduced thereby reducing the steering effect. Furthermore, when in the normal straight-ahead position the above-described 520 convergence creates a certain amount of flow resistance which causes a power loss. The outside faces of the rudders in such an assembly are normally fully convex so when these rudders are inclined to the keel axis the steering effect is reduced. Thus it is impossible with which an assembly to turn a ship in its own length, the so-called optimum turning characteristic often necessary for docking operations.

Another dual rudder balance assembly is known having assymetrical rudders (see German Petty Pat. No. 1,906,399). The leading edge of each rudder is part-cylindrical and has a center of curvature lying outside the respective central plane. Furthermore, the inner face is very convex and the outer face is flat. Thus the rudder fits well into the flow path in back of the ship. Such an arrangement has the considerable disadvantage, however, that when the rudders are turned sharply to the side there is a great deal of turbulence due to this flat outer face.

It is also known to provide a rudder system (see German published specification No. 2,303,299) having symmetrical rudders whose inner and outer faces taper backwardly at an angle of 15° to a tail portion which diverges at an angle of approximately 10°. In this arrangement the space between the rudders which acts as a diffuser first diverges then converges in the direction of flow so as to create a considerable amount of turbulence in a screw race passing between the rudders. Thus, energy which could otherwise be used to advance the ship through the water is transformed into this turbulence and wasted. Furthermore, the flow around the outside of the rudders is similarly turbulent so that drag is created.

Finally, a system is known (see U.S. Pat. No. 969,642) wherein the individual rudders can be rotated independently of one another about their respective axes. Thus, it is possible to swing them outwardly in opposite directions through 90° from the normal positions so as effectively to form a wall across the screw race with a small gap between the leading edges of the rudders constituting a chink in this wall. It is further possible with this system to swing the rudders 23° further from this position so that they lie at an obtuse angle of 113° to the keel plane in order that they deflect the normally backwardly forward stream at an angle of 20° forwardly. In such a system it is possible to use a single-direction propeller so that a direct-drive Diesel plant may be employed to drive the ship both forwardly and in reverse. Nevertheless the difficulty with such a system is that as the rudders are swung around to deflect the screw race forwardly the gap between them increases in a quadratic ratio to the angle over 90° assumed by the rudder. Thus it is standard practice in such a system to provide a so-called Steven post in the back of the rudder. This is disadvantageous because it creates two small gaps of very narrow width, causing considerable loss of thrust. Furthermore, during normal forward travel of the ship the Steven post creates considerable drag and interferes with the rudder steering.

SUMMARY OF THE INVENTION

It is therefore an object of the present invention to provide an improved rudder assembly.

Another object is the provision of such an assembly which offers minimum drag during normal straight-ahead displacement of the ship through water.

Another object is the provision of a multiple rudder assembly wherein extremely hard turning and short stopping is possible.

Yet another provision is such an arrangement wherein drag and loss of thrust both during normal straight-ahead travel, during turning to either side, and during stopping is minimized.

These objects are attained according to the present invention in a rudder assembly of the above-described general type wherein each rudder has a non-concave inner face turned toward the keel plane and an outer face formed by a convex front portion generally in front of the respective pivot axis and a concave rear portion generally behind the respective pivot axis. The rear portions diverge from the respective central planes of the rudders by angles of between 2° and 10°.

With this system it is possible to turn the ship easily within its own length. It is even possible to use such an arrangement without a Kort nozzle system and still turn it within its own length. Furthermore, during normal straight-ahead travel the rudder system presents very little drag and even when only deflected slightly a very fast steering response is obtained. In addition, if the screw is reversed, the particular shape of the propellers makes the steering response still virtually as good as when travelling forward. It is also possible with this arrangement to twist both of the rudders out away from the plane so that in a system where the screw rotates continuously in one direction it is possible to deflect the screw race partly forwardly to stop it or to even move it backward. With this system it is unnecessary to provide any moving parts on the surfaces of the rudder so that a very simple and robust construction having a long service life and low production cost is obtained.

According to further features of this invention the rear portion of the inner face of each rudder extends at an angle between 2° and 8° to the central plane of the respective rudder. It is also possible in accordance with this invention to have the rear portion of the inner space extend for a short distance virtually paralllel to the central rudder plane.

The leading edge of each rudder according to further features of this invention is part-cylindrical and has a vertical axis constituting a center of curvature. The center of curvature of the leading edge outside of the central plane lies ahead of the center of curvature of the leading edge inside the central plane. Thus when the two rudders are swung around to lie at an obtuse angle to the keel plane the liquid will break away from ahead of the rudder that is deflected further and therefore augment the steering effect.

According to yet another feature of this invention each rudder extends vertically across the cylindrical screw race and has an overall length equal to between 60% and 85% of the screw-race diameter.

Each of the rudders according to yet another feature of this invention is provided at its top and at its bottom with a flow plate. This plate extends to each side of the rudder perpendicular to the respective rudder pivot axis and has at the outside face of the rudder a portion bent away from the rudder, that is bent up above the rudder and bent down below the rudder. Such an arrangement decreases turbulence past the rudder and enhances the braking and reversing effect when the rudders are swung around through more than 90° by deflecting the reversed stream upwardly and downwardly.

The upright rudder pivot axis in accordance with this invention may lie on the central plane or be inset inwardly thereof. In the latter case these pivot axes lie in a plane including the center of curvature of the leading edge of the respective rudder and forming an angle of between 40° and 50° with the respective central rudder plane.

In accordance with a particular feature of this invention four such rudders are provided in two planes each aligned with a respective screw of a dual-screw ship. The rudders may be independently controlled so that they can all be inclined in the same approximate direction relative to the ship keel axis, or the pair on one side may be inclined outwardly in one direction and the pair on the other side outwardly in the other direction for reversing. In this arrangement it has been found that extremely good steering response is obtained by positioning the inner member of each rudder pair with its upright pivot axis in a plane ahead of a plane including the upright pivot axis of the outer member of each pair.

The novel features which are considered as characteristic are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 5 is a view similar to FIG. 4 illustrating a rudder set up useable for simultaneous backing-up and steering;

FIG. 6 is a view similar to FIG. 3 illustrating another rudder arrangement in accordance with this invention;

FIG. 7 is a top schematic view illustrating the arrangement of FIG. 6 set for a hard turn to starboard;

FIG. 8 is a top schematic view of yet another rudder system in accordance with this invention;

FIG. 9 is a top view of the system of FIG. 8 shown in the position for stopping and backing-up;

FIG. 14 is a side view corresponding generally to FIG. 1 illustrating the position of FIG. 4;

FIG. 15 is a top view of another system in accordance with this invention using rudders as in FIG. 4;

FIG. 16 is a horizontal section through a detail of the arrangement of FIG. 15;

DESCRIPTION OF THE PREFERRED EMBODIMENTS

Figure 1:
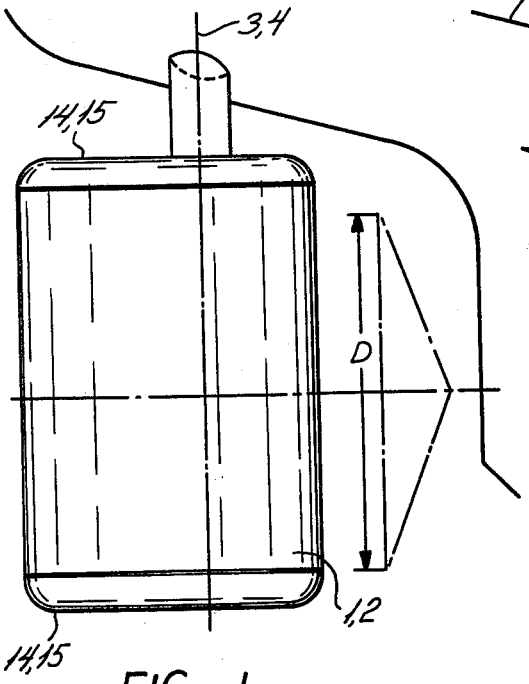
FIG. 1 is a side view of a rudder assembly according to this invention.

The arrangement shown in FIGS. 1 – 5, 10, 12 and 14 has a pair of identical rudders 1 and 2, pivotal about respective parallel axes 3 and 4 symmetrically flanking a plane P and lying in a plane P′ perpendicular to this plane P. A steering control 20 carried in a ship 23 operates independent steering motors 21 and 22 connected to the rudders 1 and 2, respectively, to rotate them about their axes 3 and 4. A screw on the ship whose orbit is indicated by circle 24 of FIG. 2 generates a cylindrical screw race having a diameter D.

Figure 3:
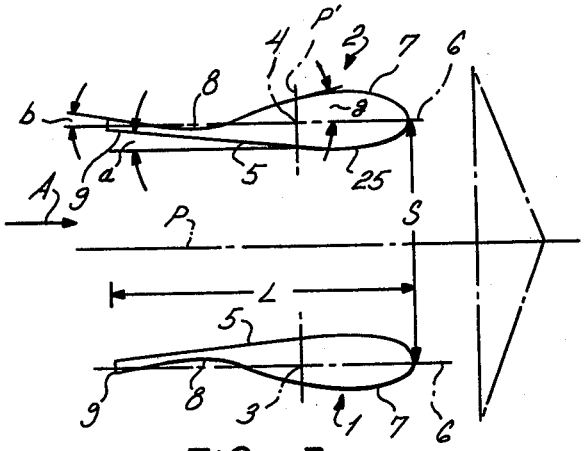
FIG. 3 is a schematic top view of the rudder assembly of FIG. 1 set for normal straight-ahead travel.
Figure 10:
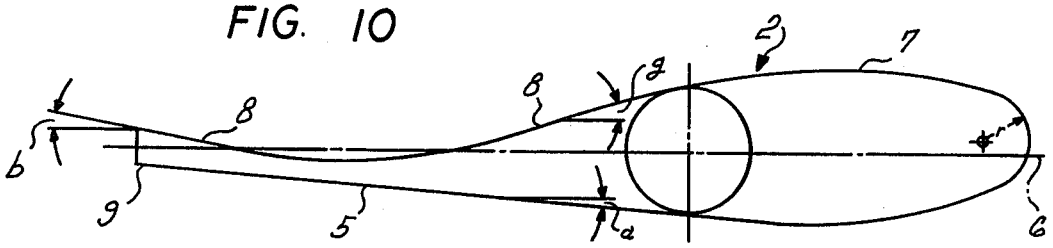
FIG. 10 is a large-scale view of one of the rudders of the system of FIGS. 1 – 5.

Each of the rudders 1 and 2 as best shown in FIGS. 3 and 10 has a central plane 6 that lies parallel to the plane P during normal straight-ahead travel of the ship 23 and which passes through the respective pivot axis 3 or 4. The rudders 1 and 2 have an outer surface formed by a leading portion 7 of convex shape and a trailing portion 8 of concave shape. Similarly, the rudders 1 and 2 each have an inner face formed by a leading portion 25 of convex shape and a trailing portion 5 of planar shape, the plane P′ defining the borders between these sections. Each rear section 5 of each inner face forms an angle *a* of between 2° and 8°, here 5° with the respective plane 6 or another plane parallel thereto. Furthermore each rear portion 8 forms at tail 9 of the respective rudder an angle *b* of between 2° and 10° with the respective plane 6. This angle *b* is decreased in order to decrease drag during straight-ahead travel and increased in order to improve maneuverability, so that depending on the type of ship this angle is increased to the maximum 10° level or decreased to the minimum 2° level. The forward portion of the rear section 8 forms an angle *g* of at most 15° with the respective plane 6. An angle of greater than 15° causes excessive turbulence and separation at the outer surface of the rudder and causes a considerably increase in flow resistance at the rudder.

Each rudder has an overall height D′ which is substantially greater than the diameter D of the screw race. In addition the rudders are spaced apart by a distance S equal to between 0.60 D and 0.70 D, here 0.65 D. The rudder length L in the direction of travel indicated by arrow A is equal to between 0.60 D and 0.85 D, here 0.80 D. Even if a rudder length L equal to 0.65 D is used it is possible to achieve the same steering efficiency that is normally achieved with a prior-art rudder having a length equal to 0.8 D, so that an efficiency increase of 23% is achieved with the system according to the present invention. In most cases the rudders are not spaced apart by a distance less than 0.65 D, but must still lie within the screw race indicated by circle 24.

Figure 4:
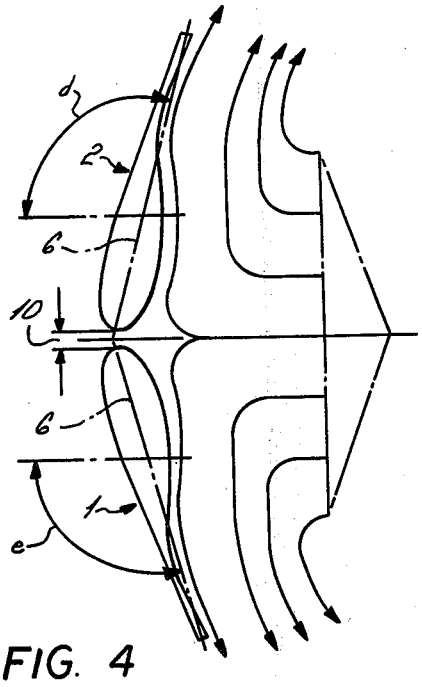
FIG. 4 is a view similar to FIG. 3 illustrating the setting of the rudders for stopping and reversing.
Figure 12:
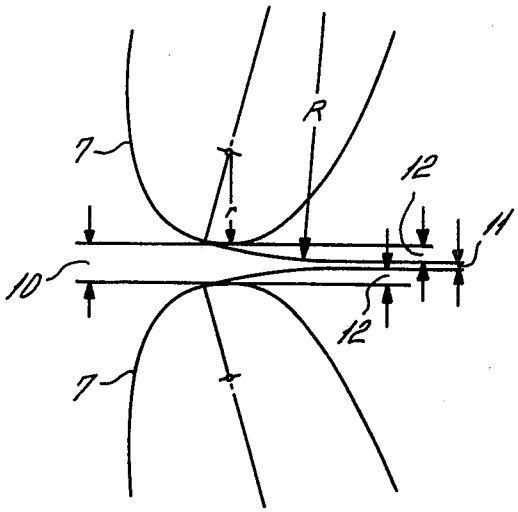
FIG. 12 is a large-scale view of a detail of the arrangement of FIG. 4.

With the system according to the present invention the rudders 1 and 2 may be set at the angles indicated at *e* and *d*, respectively, in FIG. 4 in order to stop the ship without lateral movement to either side. In this position the two rudders define a gap 10 between their leading edges and their planes 6 are positioned such that the angles *d* and *e* are equal to 105°. Such a setting causes the continuously backward flow in the screw race to be deflected partially forward at an angle of approximately 25°. The particular concave shape of the region 8 makes the flow in this direction relative smooth and free of turbulence so that a very quick stopping can be effected. As indicated in FIG. 12 this gap 10 shrinks to a gap 11 by displacement of the two leading edges of the rudders 1 and 2 through distances 12 when the planes 6 are coplanar. Such a minimal gap 11 is necessary in order to prevent the two rudders from striking and damaging one another. In fact due to the concave shape of the region 8 swinging of the rudders back through 15° from the position of FIG. 4 decreases the gap 10 by 60%.

In addition, the disadvantageous gap between the two rudders is reduced by 13% by the advantageous ratio of the large radius of curvature *r* of the front leading edge of the rudder to the radius R defined between the respective pivot axes and the leading edge along the plane 6.

FIG. 5 shows how if the one rudder 2 is pivoted through an angle *d′* substantially larger than the angle *e′* of the rudder 1 the ship will not only be stopped and drawn backwardly but its stern will be moved to port. In this arrangement the steering control 20, therefore, operates the two rudders 1 and 2 separately in order to carry out a complicated docking maneuver.

Figure 2:
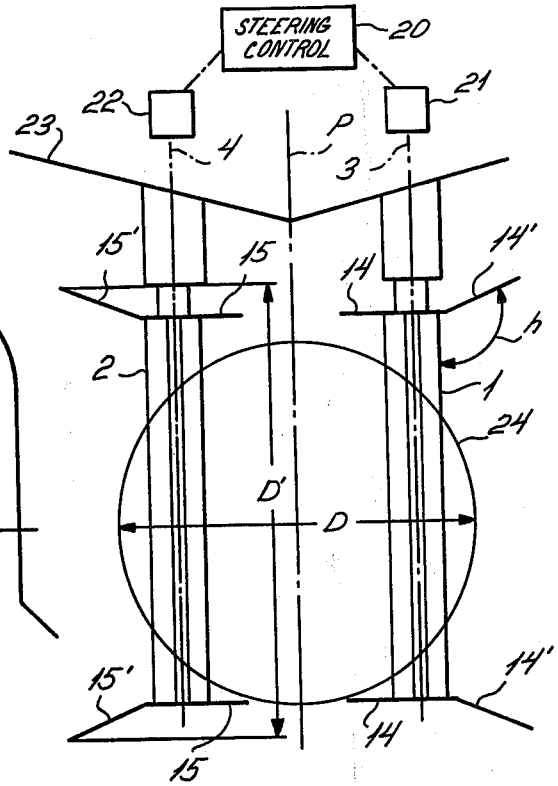
FIG. 2 is a back view partly in schematic form illustrating the assembly of FIG. 1.

Furthermore, as shown in FIGS. 1, 2 and 14 the rudder 1 is provided at its top and bottom with plates 14 and the rudder 2 with plates 15, respectively having bent-away end portions 14′ and 15′. Above the respective rudders the bent portions 14′ and 15′ are bent upwardly along a line extending parallel to the respective plane 6 and below they are similarly bent down. Such an arrangement aids as shown in FIG. 14 in turning maneuvers because it deflects the backwardly flowing stream of water not only forwardly but up and down in order to maximize the reversing effect.

Figure 11:
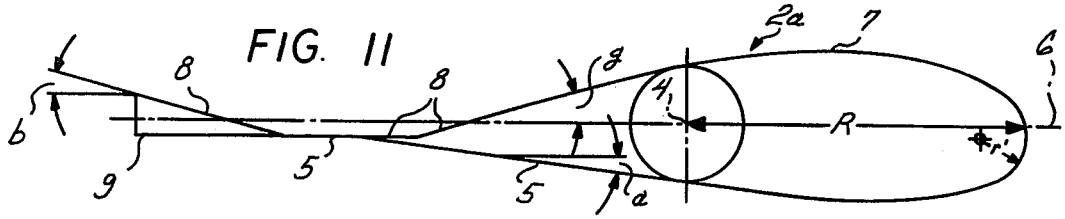
FIG. 11 is a large-scale schematic view of one of the rudders of the system of FIGS. 6 and 7, shown partly in a schematic form.

The embodiment of FIGS. 6, 7 and 11 has two rudders 1*a* and 2*a* similar to the rudders 1 and 2. The rudder 2*a* is shown in FIG. 11, however, has a radius of curvature *r′* for its front nose with a center of curvature lying offset from the plane 6 and inwardly thereof. When the rudders 1*a* and 2*a* are deflected as shown in FIG. 7 with the one rudder 1*a* deflected through an angle *e′* and the other rudder 2*a* to an angle *d′* slightly less than this angle, the offset center of curvature of the nose of the rudder 2*a* increases the drawing effect and enhances the steerability of the ship. Furthermore, each rudder has a rear portion 5 of its inner face which runs at least partially parallel to the center plane 6. Such a formation greatly reduces cavitation.

In the embodiment of FIGS. 8 and 9, the rudders 1*b* and 2*b* have leading-edge centers of curvature offset from the plane 6 and have pivot axes which lie inboard of the respective plane 6. These pivot axes 3 and 4 lie in planes 13 including the center of curvature of the leading edge and forming an angle *f* of between 40° and 50°, here 45°, with the plane 6. The axes of curvature still lie on the plane P′ perpendicular to the plane P. As is shown in FIG. 9 when such an arrangement is swung all the way around the gap 10 is reduced to a bare minimum and all of the water forced back by the screw race will be deflected forwardly again to stop the ship very abruptly. These rudders of course may be equipped with the plates 14 and 15 having bent end sections forming angles of 120° with the respective rudders.

Figure 13:
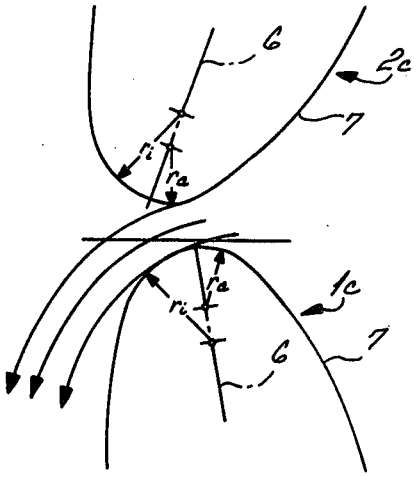
FIG. 13 is a large-scale view of an arrangement of the rudders set as shown in FIG. 5.

In the arrangement of FIG. 13 the rudders 1*c* and 2*c* have leading edges which have a short radius of curvature $r_a$ to the outside of the respective plane 6 and a longer radius of curvature $r_i$ to the outside of this plane 6. The centers of curvature for both of these radii of curvature lie on the respective planes 6. Thus, when the rudders are turned as is shown in FIG. 13 the flow of liquid between them will tend to follow the surface having the longer radius of curvature so as to increase the steering effect.

FIGS. 15 and 16 show another embodiment wherein the rudders 1*d* and 2*d* similar to the rudders 1 and 2 are provided behind a Kort nozzle 16 formed as an annular body defining the screw race having diameter D. This Kort body 16 as shown in more detail in FIG. 16 has a radial thickness 18 and a radius of curvature 17 at its trailing edge. The inner surface 19 is tangent to the curved trailing edge which is therefore formed of a plate of quarter-cylindrical shape so that it is almost perpendicular to the plate forming the outside of the Kort body 16. Thus the Kort body 16 forms a diffuser for the screw race to increase the working efficiency of the system. This arrangement can be combined with any of the other known systems, including the systems having the plates 14 and 15 which have bent up portions 14′ and 15′ extending above and below the balance of these plates by a distance equal to 0.1 d.

Figure 17:
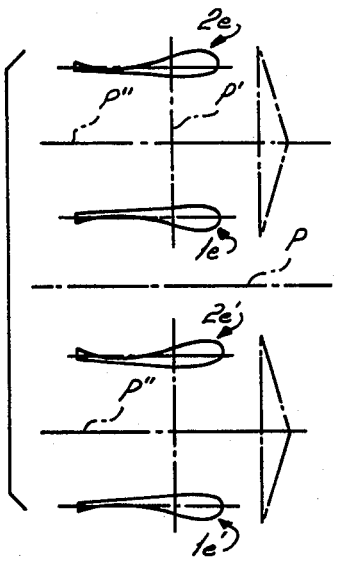
FIGS. 17, 18 and 19 are top sectional views of yet another rudder assembly according to this invention.
Figure 18:
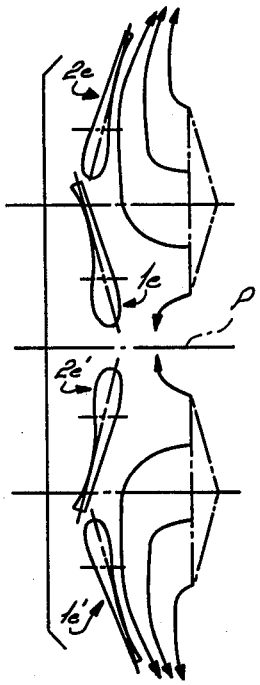
Figure 19:
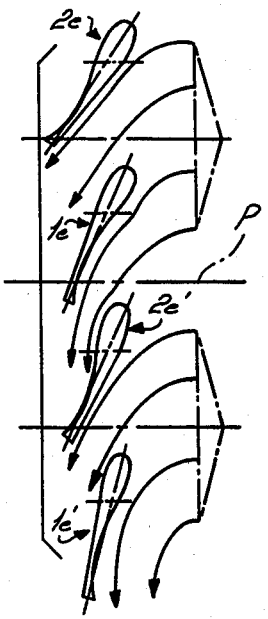

In the embodiment shown in FIGS. 17 – 19 a ship has a keel plane P and pair of screws flanking this plane P and defining a pair of screw planes P″ equispaced therefrom. A pair of rudders 1*e* and 2*e* and another pair of rudders 1*e′* and 2*e′* each flank a respective one of the planes P″, and all of the pivot axes of these rudders lie on a common plane P′ transverse to the planes P″. In such an arrangement pivoting of the one set of rudders outwardly in one direction and the other set of rudders outwardly in the other direction also, as shown in FIG. 18 causes very effective stopping and even backing of the ship. Pivoting all of the rudders in the same direction as shown in FIG. 19 steers the ship sharply to one side allowing it easily to turn within its own length.

Figure 20:
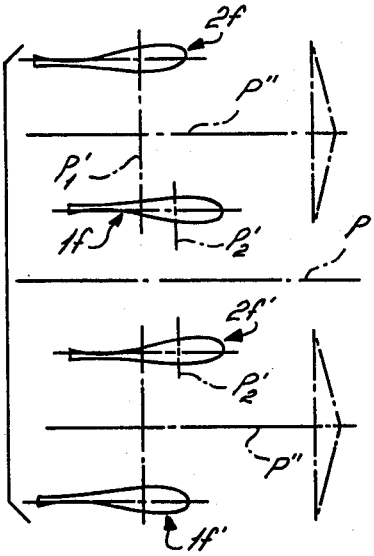
FIGS. 20, 21, and 22 are top sectional views of a further rudder assembly according to the present invention.
Figure 21:
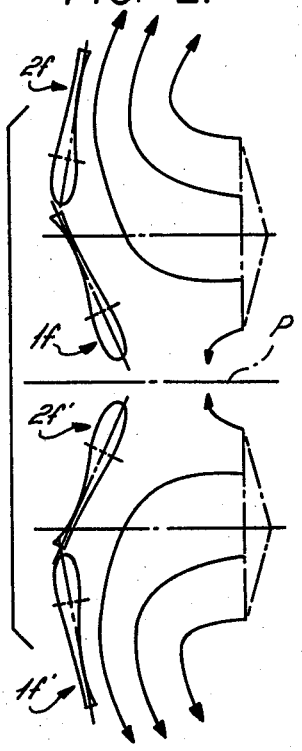
Figure 22:
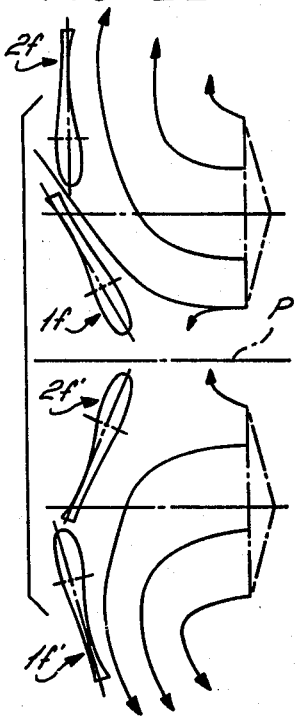

The arrangement of FIGS. 20 – 22 is employed on a ship having a keel plane P and a pair of screw race planes P′ as described immediately above. Here one pair of rudders 1*f* and 2*f* is provided flanking one plane P″ and another pair 1*f*′ and 2*f*′ flanks the other plane P″. The rudder of each pair, that is rudders 2*f* and 1*f* lying closest to the plane P is pivoted about a point lying on a plane $P'_2$ which lies ahead of the plane $P'_1$ on which the pivot axes of the rudders 1′*f* and 2*f* lie by a distance equal to 0.2 D. When such an arrangement is set as shown in FIG. 21 with all of the rudders inclined inwardly it is possible to achieve an almost total reversal of flow from the two screws. Furthermore when inclined at angles to one another as shown in FIG. 22 it is possible to stop and back the ship while swinging its stern to one side or the other very readily. In such an arrangement it is advantageous if at least the inner rudder of each pair is formed as shown in FIG. 8 that is, narrower at the respective rear portion than the other rudder of the respective pair.

It will be understood that each of the elements described above, or two or more together, may also find a useful application in other types of constructions differing from the types described above.

While the invention has been illustrated and described as embodied in a dual rudder assembly, it is not intended to be limited to the details shown since various modifications and structural changes may be made without departing in any way from the spirit of the present invention.

Without further analysis, the foregoing will so fully reveal the gist of the present invention that others can by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In combination with a ship having a pair of drives generating a pair of parallel screw races passing backwardly parallel to each other to each side of a ship keel plane, the improvement comprising a pair of rudders in each of said races pivotal about parallel pivot axes, the pivot axes of each pair being equispaced to either side of the center of the respective race, each rudder having a central plane lying parallel to said keel plane during normal straight forward travel of said ship, each rudder further having an inner face turned toward the center of the respective screw race and an outer face formed by a convex front portion generally in front of the respective pivot axis and a concave rear portion generally behind the respective axis and forming with the respective central plane an angle of between 2° and 10°, the axis of the rudder of each pair further from said keel plane lying behind the other axis of each pair.

* * * * *